United States Patent [19]

Inoue et al.

[11] Patent Number: 4,849,319

[45] Date of Patent: Jul. 18, 1989

[54] SILVER HALIDE PHOTOGRAPHIC LIGHT-SENSITIVE MATERIAL AND METHOD OF FORMING SUPER-HIGH CONTRAST NEGATIVE IMAGE USING THE PHOTOGRAPHIC MATERIAL

[75] Inventors: Nobuaki Inoue; Senzo Sasaoka; Hiroshi Hayashi, all of Kanagawa, Japan

[73] Assignee: Fuji Photo Film Co., Ltd., Kanagawa, Japan

[21] Appl. No.: 124,442

[22] Filed: Nov. 20, 1987

Related U.S. Application Data

[63] Continuation-in-part of Ser. No. 846,679, Apr. 1, 1986, abandoned.

[30] Foreign Application Priority Data

Apr. 1, 1985 [JP] Japan ..... 60-68873

[51] Int. Cl.[4] ..... G03C 1/33; G03C 5/26

[52] U.S. Cl. ..... 430/264; 430/949; 430/599; 430/609; 430/266; 430/267; 430/444; 430/445; 430/446; 430/448

[58] Field of Search ..... 430/949, 264, 599, 609, 430/266, 267, 444, 445, 446, 448

[56] References Cited

U.S. PATENT DOCUMENTS

| | | | |
|---|---|---|---|
| 2,853,457 | 9/1958 | Gates, Jr. | 430/536 |
| 3,488,708 | 1/1970 | Smith | 430/536 |
| 3,607,290 | 9/1971 | Butler | 430/627 |
| 4,269,929 | 5/1981 | Nothnagle | 430/264 |
| 4,332,878 | 6/1982 | Akimura et al. | 430/264 |
| 4,560,638 | 12/1985 | Loblaw et al. | 430/264 |

*Primary Examiner*—Paul R. Michl
*Assistant Examiner*—Lee C. Wright
*Attorney, Agent, or Firm*—Sughrue, Mion, Zinn, Macpeak, and Seas

[57] ABSTRACT

A negative silver halide photographic material comprising a support and at least one silver halide emulsion layer on the support, the emulsion layer or other hydrophilic colloid layer containing a hydrazine derivative, wherein the photographic material further contains an acid polymer and in which the pH of the surface of the photographic material is not more than 5.8. Also, a method for forming a superhigh contrast negative image using the above photographic material is disclosed.

24 Claims, No Drawings

SILVER HALIDE PHOTOGRAPHIC LIGHT-SENSITIVE MATERIAL AND METHOD OF FORMING SUPER-HIGH CONTRAST NEGATIVE IMAGE USING THE PHOTOGRAPHIC MATERIAL

This is a continuation-in-part of application Ser. No. 06/846,679 filed Apr. 1, 1986 now abandoned.

FIELD OF THE INVENTION

The present invention relates to a silver halide photographic material and a method for forming a superhigh contrast negative image using the light-sensitive material. More particularly, it is concerned with a silver halide photographic material for use in photomechanical process and also to a method for forming a superhigh contrast negative image using the light-sensitive material.

BACKGROUND OF THE INVENTION

A method capable of forming an image of superhigh contrast (particularly having a gamma value (γ) of at least 10) is needed in the graphic art field in order to ensure good reproduction of an image of continuous tone utilizing a dot image or good reproduction of line image.

Heretofore, for this purpose, a special developer called a "lith developer" has been used. The lith developer contains only hydroquinone as a developing agent, and the concentration of free sulfite ions in the lith developer is greatly decreased usually to not more than 0.1 mol/l by adding a sulfite as a preservative in the form of an adduct with formaldehyde so as not to inhibit the infectious developing properties of the lith developer. For this reason, the lith developer has a vital disadvantage in that it is readily subject to air oxidation and thus cannot be stored for more than 3 days.

In order to obtain an image of high contrast using a stable developer, U.S. Pat. Nos. 4,224,401, 4,168,977, 4,166,742, 4,311,781, 4,272,606, 4,211,857 and 4,243,739 disclose methods using hydrazine derivatives. In accordance with these methods, photographic characteristics of superhigh contrast and high sensitivity can be obtained, and moreover, since a high concentration of a sulfite can be added to the developer, the stability of the developer against air oxidation is markedly increased compared with the lith developer.

The above image forming system, however, causes an undesirable phenomenon, e.g., formation of black spots due to infectious development although it provides high sensitivity and high contrast. This formation of black spots is a serious problem in the photomechanical process. These black spots, sometimes called "black pepper", appear at positions between halftone dot and halftone dot, which are to become non-exposed areas. The formation of black spots is accelerated when the light-sensitive material is stored for long periods of time, particularly under high temperature/high humidity conditions, or by a reduction in the amount of sulfite ions generally used as a preservative and an increase in pH as a result of fatigue of the developer with a lapse of time. Thus, the commercial value of the light-sensitive material as a material for use in the photomechanical process is seriously decreased.

In order to overcome the problem of black spots as described above, extensive investigations have been made. Improvement of black spots, however, often leads to a reduction in sensitivity and gamma (γ). It has therefore been desired to overcome the problem of black spots while maintaining sensitivity and contrast at high levels.

SUMMARY OF THE INVENTION

An object of the present invention is to provide a silver halide photographic material having such photographic characteristics that when developed with a stable developer, the gamma (γ) is as high as more than 10, and the formation of black spots is decreased while maintaining high sensitivity and high contrast.

Another object of the present invention is to provide a method for forming an image utilizing the above photographic material.

It has been found that the above objects can be attained by adding an acidic polymer to an emulsion layer or other hydrophilic colloid layer and maintaining the pH of the surface of the photographic material at not more than 5.8.

The present invention relates to a negative silver halide photographic material comprising a support and at least one silver halide emulsion layer on the support, and containing in said emulsion layer or in a light-insensitive hydrophilic colloid layer a hydrazine derivative, wherein the photographic material further contains an acid polymer and in which the pH of the surface of the material is not more than 5.8.

The present invention also relates to a method for forming a superhigh contrast negative image using the above photographic material which comprises exposing imagewise the photographic material and then developing it with a developer containing at least 0.15 mol/l of sulfite ions and having a pH of from 10.5 to 12.3.

DETAILED DESCRIPTION OF THE INVENTION

The hydrazine derivatives of the present invention include hydrazine derivatives having a sulfinyl group as described in U.S. Pat. No. 4,478,928 which is hereby incorporated by reference, and the compounds represented by the following general formula (I):

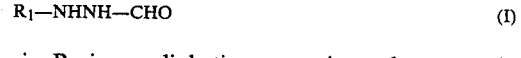

$$R_1\text{—NHNH—CHO} \quad (I)$$

wherein $R_1$ is an aliphatic, aromatic or heterocyclic group.

The aliphatic group represented by $R_1$ in the general formula (I) preferably has from 1 to 30 carbon atoms. Particularly preferred is a straight, branched or cyclic alkyl group having from 1 to 20 carbon atoms. The branched alkyl group may be cyclized so as to form a saturated hetero ring containing one or more hetero atoms. Moreover, the alkyl group may be substituted with one or more groups such as an aryl group, an alkoxyl group, a sulfoxy group, a sulfonamide group, and a carbonamide group. Examples include a tert-butyl group, an n-octyl group, a tert-octyl group, a cyclohexyl group, a pyrrolidyl group, an imidazolyl group, a tetrahydrofuryl group, and a morpholino group.

The aromatic or heterocyclic group represented by $R_1$ in the general formula (I) is a mono- or bicyclic aryl group or an unsaturated heterocyclic group. This unsaturated heterocyclic group may be condensed with the mono- or bicyclic aryl group to form a heteroaryl group. Examples of the suitable aromatic groups or heterocyclic groups include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Those containing a benzene ring are particularly preferred.

Particularly preferred among the groups represented by $R_1$ is an aryl group.

The aryl group, aromatic group or heterocyclic group represented by $R_1$ may be substituted. Typical substituents include a straight, branched or cyclic alkyl group (preferably having from 1 to 20 carbon atoms), an aralkyl group (preferably a mono- or bicyclic group comprising the alkyl portion having 1 to 3 carbon atoms), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamide group (preferably having from 1 to 30 carbon atoms), and a ureido group (preferably having from 1 to 30 carbon atoms). Of these, particularly preferable substituents are an acylamino group or a ureido group.

The groups of $R_1$ may be provided with a ballast group commonly introduced in immobile photographic additives such as a coupler. The ballast group is a group having 8 or more carbon atoms and relatively inert to photographic properties. Typical examples of the ballast groups include an alkyl group, an alkoxyl group, a phenyl group, an alkylphenyl group, a phenoxy group, and an alkylphenoxy group.

In the groups of $R_1$ there may be introduced a group capable of increasing adsorption onto the surface of silver halide particles. Typical examples of such adsorbing groups include groups such as a thiourea group, a heterocyclic thioamide group, a mercapto heterocyclic group, and a triazole group, as described in U.S. Pat. No. 4,385,108.

These compounds can be prepared by the methods described in U.S. Pat. Nos. 4,168,977, 4,224,401, 4,171,977, and 4,323,643.

The compound of the general formula (I) when incorporated in a photographic light-sensitive material is preferably added to a silver halide emulsion layer, but may be added to other light-insensitive hydrophilic colloid layers such as a protective layer, an interlayer, a filter layer, and an antihalation layer. When the compound to be used is soluble in water, it is applied in the form of an aqueous solution. In the case of compounds which are sparingly soluble in water, they are dissolved in an organic solvent compatible with water, such as alcohols, esters and ketones and added to a hydrophilic colloid solution. When the compound is added to a silver halide emulsion layer, it may be added at any desired stage between the start of chemical ripening and coating. Preferably the compound is added during the period between completion of chemical ripening and coating. More preferably the compound is added to a coating liquid prepared for coating.

The optimum amount of the compound of the general formula (I) being added varies with the diameter of particles of silver halide, halogen composition, and method and extent of chemical sensitization of the silver halide emulsion, the relation between the layer to which the compound is to be added and the silver halide emulsion layer, the type of an antifoggant, and so forth. This optimum amount can be easily determined by one skilled in the art according to known testing methods. The amount of the compound of the general formula (I) being added is preferably from $1\times10^{-6}$ to $1\times10^{-1}$ mol per mol of silver halide, more preferably from $1\times10^{-5}$ to $4\times10^{-2}$ mol per mol of silver halide.

Typical examples of the compound of the general formula (I) are shown below although the present invention is not intended to be limited thereto.

I-1

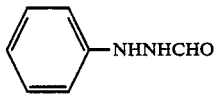

I-2

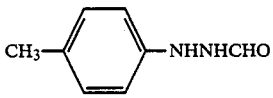

I-3

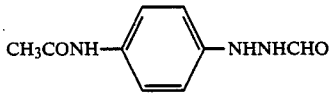

I-4

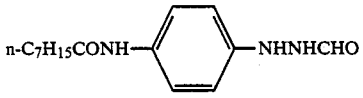

I-5

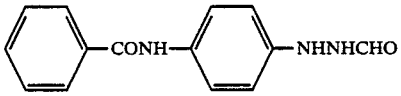

I-6

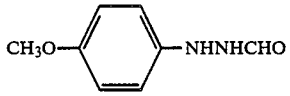

-continued
I-7
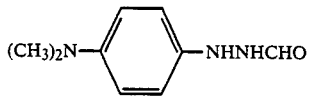
I-8
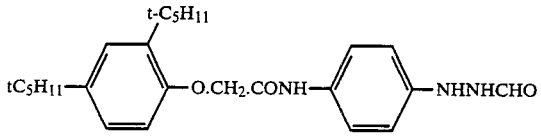
I-9
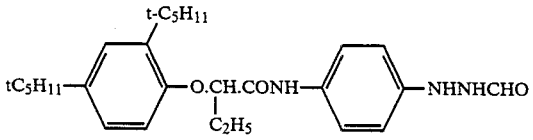
I-10
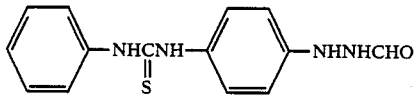
I-11
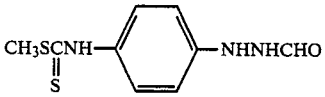
I-12
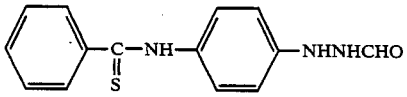
I-13
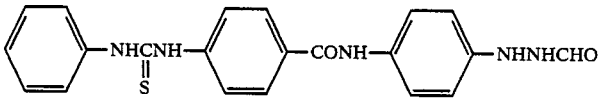
I-14
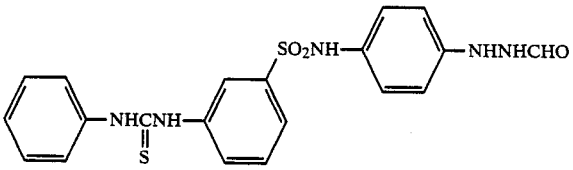
I-15
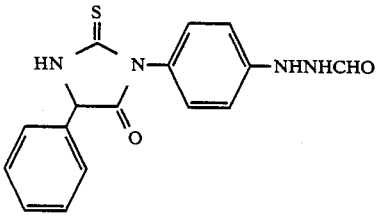
I-16
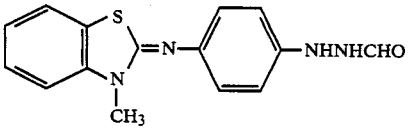
I-17
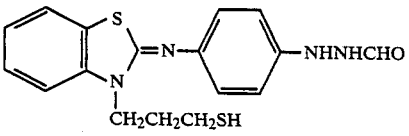

-continued
I-18
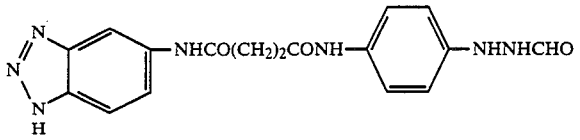
I-19
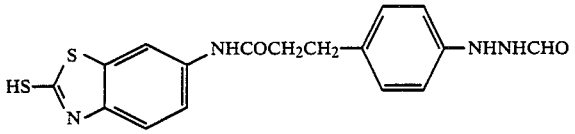
I-20
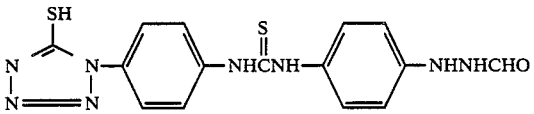
I-21
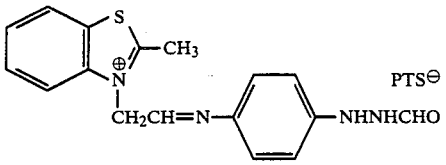
I-22
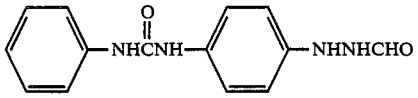
I-23
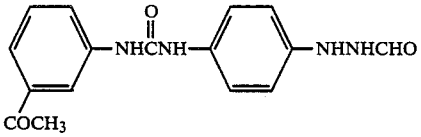
I-24
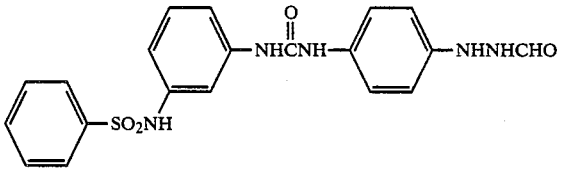
I-25
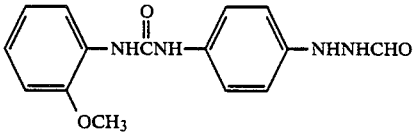
I-26
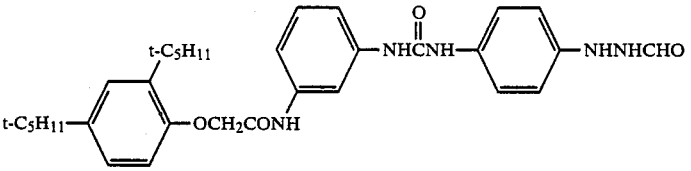
I-27
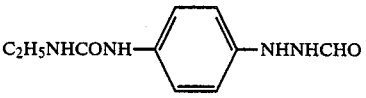
I-28
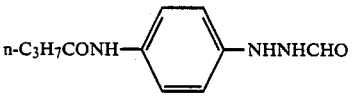

-continued

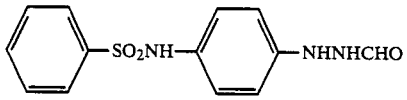

In addition, the following compounds as described in U.S. Pat. No. 4,478,928 can be used.

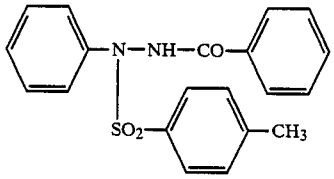

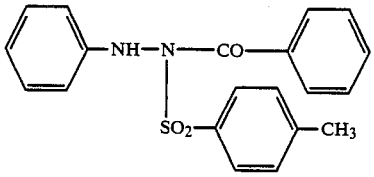

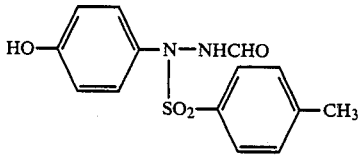

Acid polymers which are preferably used in the present invention are polymers containing an acidic group or its precursor providing an acidic group upon hydrolysis, having a pKa of not more than 9. Polymers containing a carboxyl group are preferred. More preferred are higher fatty acids such as oleic acid as described in U.S. Pat. No. 2,983,606, polymers of acrylic acid, methacrylic acid or maleic acid, or their partially esterified products or acid anhydrides, as described in U.S. Pat. No. 3,362,819, copolymers of acrylic acid and acrylate as described in French Pat. No. 2,290,699, and latex type acid polymers as described in U.S. Pat. No. 4,139,383 and *Research Disclosure,* No. 16102 (August, 1977).

In addition, acid polymers as described in U.S. Pat. Nos. 4,088,493, 4,149,890 and 4,149,,891, Japanese Patent Application (OPI) Nos. 1023/78, 4540/78 and 4542/78 (the term "OPI" as used herein refers to a "published unexamined Japanese patent application") can be used.

Representative examples of the acid polymers are copolymers of vinyl monomers such as ethylene, vinyl acetate and vinyl methyl ether, and maleic anhydride, and their n-butyl half-esters; a copolymer of butyl acrylate and acrylic acid; and cellulose acetate hydrogen phthalate. Of these, a copolymer of butyl acrylate and acrylic acid is particularly preferred.

The acid polymer in accordance with the present invention contains from 40 to 100 mol %, based on the polymer, of a repeating unit comprising a carboxylic acid group or a carboxylic acid anhydride group.

If the amount of the carboxylic acid group or the carboxylic acid anhydride group is less than 40 mol % based on the polymer the effects of the present invention in decreasing the formation of black spots while maintaining high sensitivity and high contrast are not obtained.

It is to be specifically noted that prior art dealing, for example, with the use of a copolymer of an alkyl acrylate and acrylic acid to improve dimensional stability contemplates an amount of acrylic acid in such copolymer in a maximum amount of up to 25 mol %; at such amount, the objects of the present invention cannot be achieved.

Typical carboxylic acid anhydride groups in acid polymers according to the present invention are shown in acid polymers II-3, -6, -7, -9 and -10 in the specification.

In addition, partially hydrolyzed cellulose acetate; polymers such as polyvinyl acetate, decreasing alkali transmissivity; latex polymers increasing activation energy for alkali transmission as prepared by copolymerizing a small amount of a hydrophilic comonomer such as an acrylic monomer; polymers having a lactone ring; and polymers releasing an acid (which may be a low molecular weight acid) during the production of the light-sensitive material, such as preparation of a coating liquid and drying, or the storage of the light-sensitive material; are useful.

Particularly preferred are cellulos acetate as described in Japanese Patent Application (OPI) No. 136328/79 and U.S. Pat. Nos. 4,267,262 and 4,009,030; latex polymers prepared by copolymerizing a small amount of a hydrophilic comonomer such as acrylic acid as described in Japanese Patent Application (OPI) No. 6843/82, U.S. Pat. Nos. 4,199,362, 4,256,827 and 4,268,604; polymers containing a lactone ring as described in U.S. Pat. No. 4,229,516; and polymers as described in U.S. Pat. Nos. 3,778,265, 4,088,493, 4,123,275, 4,148,653, 4,201,587 and 4,288,523.

All of the above referred to reference relating to acid polymers are hereby incorporated by reference.

When the acid polymer of the present invention is added to a photographic light-sensitive material, it may be added to a silver halide emulsion layer or light-insensitive hydrophilic colloid layer. It is preferred that the acid polymer be added to a light-insensitive hydrophilic colloid layer adjacent to the emulsion layer or a substantially hydrophobic polymer (preferably being a copolymer of acrylic acid) layer adjacent to or lower than the emulsion layer. In the case of acid polymers which are difficult to disperse in a hydrophilic colloid layer, they can be introduced in combination with other polymers to a layer which differs from the hydrophilic colloid layer.

Polymers which are useful to use in combination with the acid polymer include polyacrylamide, polymethylpyrrolidone, polyvinyl alcohol (including partially saponified products), carboxymethyl cellulose, hydroxymethyl cellulose, hydroxypropyl cellulose, polymethylvinyl ether, cellulose acetate and vinyl acetate. These polymers are commercially available, from which a suitable one can be chosen.

It is desirable for the amount of the acid polymer being coated to be determined appropriately depending on the acidic portion content of the polymer, processing conditions, the amounts of various additives being added, and so forth. The amount of the acid polymer being coated is suitable from 10 mg/m$^2$ to 10 g/m$^2$ and preferably 20 mg/m$^2$ to 2.5 g/m$^2$. *The amount of the acid group is suitably from* 0.1 to 100 mmol/m$^2$ and preferably from 0.5 to 50 mmol/m$^2$.

It is particularly preferred for the acid polymer of the present invention to be added in such an amount that the pH of the surface of the light-sensitive material is not more than 5.8, preferably from 4.0 to 5.6. The pH of the surface is determined by the following method:

0.05 ml of distilled water is dropped on 1 cm$^2$ of the surface of a light-sensitive material at the silver halide emulsion layer side, the light-sensitive material comprising a support, and a silver halide emulsion layer and a light-sensitive hydrophilic colloid layer provided on the support, and is allowed to stand for 10 minutes in an atmosphere of 90% RH. Then, the pH of the water is measured using a plate-shaped glass electrode (plate-shaped composite electric power) with a silver chloride electrode (AgCl/KCl) as a base electrode, both being assembled into one body. An example of the composite electrode is a plate-shaped electrode GS-165F produced by Toa Denpa Kogyo Co. Ltd.

Representative examples of the acid polymer (II) are shown below although the present invention is not limited thereto.

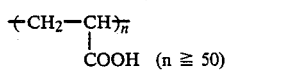
II-1

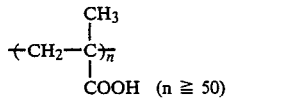
II-2

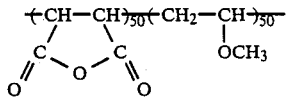
II-3

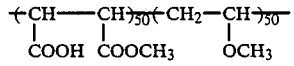
II-4

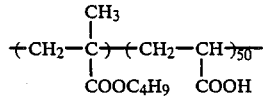
II-5

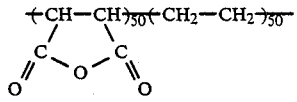
II-6

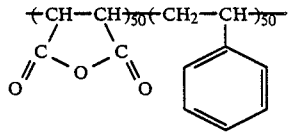
II-7

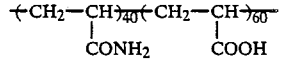
II-8

-continued

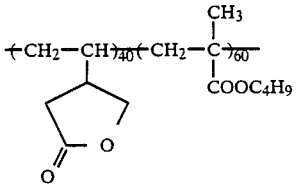
II-9

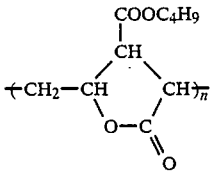
II-10

(n ≧ 50)

The silver halide emulsion as used herein may contain any of silver chloride, silver chlorobromide, silver iodobromide and silver iodochlorobromide. Silver halide comprising not less than 70 mol % of silver bromide is preferred, with silver halide comprising not less than 90 mol % of silver bromide being more preferred. The silver iodide content is preferably not more than 10 mol % and more preferably from 0.1 to 5 mol %.

The average particle size of silver halide as used herein is preferably not more than 0.7 μm and particularly preferably not more than 0.5 μm. The particle size distribution is not critical. It is preferred, however, that the silver halide particles are of a monodispersion type. The term "monodispersion type" as used herein means that at least 95% of the particles, as determined based on either weight or number of particles, have particle sizes falling within the range of average particle size ± 40%.

The silver halide particles in the photographic emulsion may have a regular form crystal, such as a cubic form or an octahedral form, or an irregular form crystal, such as a spherical form or a tabular form, or a composite form crystal thereof.

In the silver halide particles, the inside portion and the surface layer may be the same or different in phase. Two or more silver halide emulsions as prepared independently may be used as a mixture.

In preparation of the silver halide emulsion as used herein, salts such as cadmium salts, sulfite, lead salts, thallium salts, rhodium salts or its complex salts, and iridium salts or its complex salts may be allowed to coexist during the process of formation or physical ripening of the silver halide particles.

As silver halide to be used in the present invention, silver haloiodide is most suitable which is prepared in the presence of from $1\times10^{-8}$ to $1\times10^{-5}$ mol per mol of silver of an iridium salt or its complex salt, and in which the silver iodide content of the particle surface is greater than the average silver iodide content of the particles. Use of an emulsion containing such a silver haloiodide provides such photographic characteristics that the sensitivity is much higher and the gamma value is high.

It is desirable to add the above specified amount of iridium salt before completion of physical ripening in the preparation of the silver halide emulsion, particularly at the time of formation of particles.

The iridium salt as used herein is a water-soluble iridium salt or its complex salt. Examples of the iridium salt are iridium trichloride, iridium tetrachloride, potassium iridiumm (III) hexachloride, potassium iridium (IV) hexachloride, and ammonium iridium (III) hexachloride.

As a binder or a protective colloid for the photographic emulsion, it is advantageous to use gelatin. Other hydrophilic colloids can also be used. For example, proteins such as gelatin derivatives, graft polymers of gelatin and other polymers, albumin and casein; cellulose derivatives such as hydroxyethyl cellulose, carboxymethyl cellulose and cellulose sulfate; sugar derivatives such as sodium alginate and starch derivatives; and various synthetic hydrophilic polymeric substances, e.g., homopolymers or copolymers, such as polyvinyl alcohol, polyvinyl alcohol partial acetal, poly-N-vinylpyrrolidone, polyacyrlic acid, polymethacrylic acid, polyacrylamide, polyvinyl imidazole and polyvinyl pyrazole can be used.

Gelatin that can be used in the present invention include, as well as lime-processed gelatin, acid-processed gelatin, gelatin hydrolyzates, and gelatin enzyme decomposition products.

After precipitate formation or physical ripening the emulsion is usually freed of soluble salts. For this purpose, known techniques can be employed. For example, the noodle rinsing method in which gelatin is gelled, and the flocculation method utilizing inorganic salts comprising polyvalent anions, such as sodium sulfate, anion surface active agents, anionic polymers (e.g., polystyrenesulfonic acid), or gelatin derivatives (e.g., aliphatic acylated gelatin, aromatic acylated gelatin, and aromatic carbamoylated gelatin) can be employed. The step of removing soluble salts may be omitted.

The silver halide emulsion which is used in the present invention may or may not be chemically sensitized. This chemical sensitization can be carried out by known techniques such as sulfur sensitization, reduction sensitization and noble metal sensitization. These techniques can be applied alone or in combination with each other.

A typical example of the noble metal sensitization method is gold sensitization. For the gold sensitization, gold compounds, particularly gold complex salts are used. The complex salts of noble metals other than gold, such as platinum, palladium, and iridium may be used. Representative examples are described in, for example, U.S. Pat. No. 2,448,060 and British Pat. No. 618,061.

Sulfur sensitizing agents which can be used include, as well as sulfur compounds contained in gelatin, various compounds such as thiosulfates, thioureas, thiazoles, and rhodanines.

Reduction sensitizing agents which can be used include stannous salts, amines, formamidinesulfinic acid and silane compounds.

To the photographic light-sensitive material of the present invention can be added sensitizing dyes (e.g., cyanine dyes and merocyanine dyes) as described in U.S. Pat. No. 4,221,857 for the purpose of increasing sensitivity.

These sensitizing dyes can be used alone or in combination with each other. Combinations of sensitizing dyes are often used particularly for the purpose of supersensitization. In combination with the sensitizing dye, dyes not having a spectral sensitization action by themselves, or substances not substantially absorbing visible light and exhibiting supersensitization may be added to the emulsion.

Useful combination of sensitizing dyes and dye having the supersensitization action, and substances having the supersensitization action are described in *Research Disclosure,* Vol. 176, 17643, page 23 (published in December, 1978), Clause IV-J.

Various compounds can be added to the light-sensitive material of the present invention for the purpose of preventing fog during the process of preparation, the storage or the photographic processing of the light-sensitive material, or for the purpose of stabilizing the photographic characteristics. For example, many compounds known as antifoggants or stabilizers, e.g., azolels such as benzothiazolium salts, nitroindazoles, chlorobenzimidazoles, bromoimidazoles, mercaptothiazoles, benzotriazoles, mercaptobenzothiazoles, mercaptothiadiazoles, aminotriazoles, benzothiazoles and nitrobenzotriazoles; mercaptopyrimidines; mercaptotriazines; thioketo compounds such as oxazolidinedione; azaindenes such as triazaindenes, tetraazaindenes (particularly 4-hydroxy-substituted (1,3,3*a*,7)tetraazaindenes), pentaazaindenes; benzenethiosulfonic acid, benzenesulfinic acid, and benzenesulfonic acid amide can be added. Of these compounds, benzotriazoles (e.g., 5-methylbenzotriazole) and nitroindazoles (e.g., 5-nitroindazole) are preferred. The above compounds can be added to a processing solution.

In the photographic light-sensitive material of the present invention, inorganic or organic hardening agents may be added to the photographic emulsion layer or hydrophilic colloid layer. Examples of such hardening agents include chromium salts (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5 -triacryloyl-hexahydro-s-triazine and 1,3-vinylsulfonyl-2-propanol), active halogen compounds (e.g., 2,4-dichloro-6-hydroxy-s-triazine), mucohalogenic acids (e.g., mucochloric acid and mucophenoxychloric acid), epoxy compounds (e.g., tetramethylene glycol diglycidyl ether), and isocyanate compounds (e.g., hexamethylene diisocyanate). These compounds can be used alone or in combination with each other.

In addition, the photographic emulsion layer or hydrophilic colloid layer may contain various surfactants as coating aids, or for various purpose such as prevention of electrification, improvement of sliding properties and emulsification or dispersion, prevention of adhesion, and improvement of photographic characteristics (e.g., acceleration of development, increasing contrast, and sensitization).

Examples of such surfactants include nonionic surfactants such as saponin (steroids), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, and a silicone-polyethylene oxide adduct), glycidol derivatives (e.g., alkenylsuccinic acid polyglyceride and alkylphenol polyglyceride), fatty acid esters of polyhydric alcohols, and alkyl esters of sugar; anionic surfactants containing an acid group (e.g., a carboxyl group, a sulfo group, a phospho group, a sulfate group, and a phosphate group), such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylenealkylphosphoric acid esters; amphoteric surfactants such as amino acids, aminoalkylsulfonic acids, aminoalkylsulfuric acid or aminoalkylphosphoric acid esters, alkylbetaines, and amine oxides; and cationic surfactants such as alkylamine salts, aliphatic or aromatic quaternary ammonium salts, heterocyclic (e.g., pyridinium and imidazolium) quaternary ammonium salts, and aliphatic or heterocyclic ring-containing phosphonium or sulfonium salts.

Surfactants which are preferably used in the present invention are polyalkylene oxides having a molecular weight of more than 600 as described in U.S. Pat. No. 4,221,857.

The photographic emulsion layer or hydrophilic colloid layer of the photographic light-sensitive material of the present invention may contain a matting agent such as silica, magnesium oxide and polymethyl methacrylate for the purpose of, e.g., preventing adhesion.

The photographic light-sensitive material of the present invention may contain a dispersion of a water-insoluble or sparingly soluble synthetic polymer for the purpose of improving its dimensional stability. For example, homo- and copolymers of comonomers such as alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefin and styrene; and copolymers of the above comonomers and comonomers such as acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid can be used. For example, polymers as described in U.S. Pat. Nos. 2,376,005, 2,739,137, 2,853,457, 3,062,674, 3,411,911, 3,525,620, 3,607,290 and 3,645,740 can be also used.

In the present invention, if an acid is added directly to a silver halide emulsion containing the above polymer latex to such an extent that the above specified surface pH can be obtained, aggregates are often formed in the coating solution, thereby making it difficult to coat the coating solution. Accordingly, it is particularly advantageous to incorporate an acid polymer having a low diffusion rate into a layer except for a hydrophilic colloid layer.

To obtain photographic characteristics of super contrast and high sensitivity with the light-sensitive material of the present invention, it is not necessary to use conventional infectious developers and high alkali developers having a pH reaching about 13 as described in U.S. Pat. No. 2,419,975, and stable developers can be used. That is, the light-sensitive material of the present invention can obtain a negative image of sufficiently high contrast having a gamma ($\gamma$) of not less than 10 when developed with a developer containing not less than 0.15 mol/l (developer), and preferably from 0.2 to 0.8 mol/l (developer) of sulfite ion as a preservative and having a pH of 10.5 to 12.3, particularly 11.0 to 12.0.

There are no special limitation for the developing agent to be used in the present invention. For example, dihydroxybenzenes (e.g., hydroquinone), 3-pyrazolidones (e.g., 1-phenyl-3-pyrazolidone and 4,4-dimethyl-1-phenyl-3-pyrazolidone), and aminophenols (e.g., N-methyl-p-aminophenol) can be used alone or in combination with each other.

The light-sensitive material of the present invention can be processed with a developer containing dihydroxybenzenes as main developing agents and 3-pyrazolidones or aminophenols as auxiliary developing agents. Preferably, the concentration of dihydroxybenzenes in the developer is from 0.05 to 0.5 mol/l (developer) and the concentration of 3-pyrazolidones or aminophenols in the developer is not more than 0.06 mol/l (developer).

As described in U.S. Pat. No. 4,269,929, the rate of development can be increased and the developing time can be shortened by adding amines to the developer.

The developer may further contain a pH buffer, such as the sulfites, carbonates, borates and phosphates of alkali metals, a development inhibitor, such as bromides, iodides and organic antifoggants (particularly preferably nitroindazoles and benzotriazoles), and an antifoggant. If desired, the developer may further contain a hard water softening agent, a dissolving acid, a color controlling agent, a development accelerator, a surfactant (particularly preferably polyalkylene oxides as described above), a defoaming agent, a hardening agent, and an agent to prevent silver stain of film (e.g., 2-mercaptobenzimidazolesulfonic acids).

A fixer having a commonly used composition can be used in the present invention. As the fixing agent, thiosulfates and thiocyanates, and organic sulfur compounds known to be effective as fixing agents can be used. The fixer may contain water-soluble aluminum salts, for example, as hardening agents.

In the present invention, the processing temperature is usually chosen within the range of from 18° to 50° C.

The photographic light-sensitive material of the present invention preferably is processed by using an automatic developing machine. With the light-sensitive material of the present invention, photographic characteristics of superhigh contrast and negative gradation can be obtained even when the total processing time from the introduction into the automatic developing machine to the withdrawal therefrom is set to from 90 to 120 seconds.

The photographic light-sensitive material of the present invention provides a number of advantages including the fact that dot and line images can be efficiently reproduced, the contrast is high, and formation of black spots is greatly improved, as a result of the introduction of hydrazine derivatives as represented by the general formula (I) and acid polymers.

the present invention is described below in greater detail by reference to the following examples.

A developer having the following formulation was used in the examples.

| Basic Formulation of Developer | |
|---|---|
| Hydroquinone | 35.0 g |
| N—Methyl-p-aminophenol.½ Sulfate | 0.8 g |
| Sodium Hydroxide | 13.0 g |
| Potassium Triphosphate | 74.0 g |
| Potassium Sulfite | 90.0 g |
| Tetrasodium Ethylenediaminetetraacetate | 1.0 g |
| Potassium Bromide | 4.0 g |
| 5-Methylbenzotriazole | 0.6 g |
| 3-Diethylamino-1,2-propanediol | 15.0 g |
| Water to make | 1,000 ml (pH = 11.5) |

EXAMPLE 1

An aqueous silver nitrate solution and an aqueous solution of potassium iodide and potassium bromide were added at the same time to an aqueous gelatin solution maintained at 50° C. over 60 minutes in the presence of $4\times10^{-7}$ mol per mol of Ag of iridium (III)

hexachloride and ammonia while maintaining the pAg at 7.8 to thereby prepare a cubic monodispersion emulsion having an average particle diameter of 0.25 μm and an average silver iodide content of 1 mol %. To the emulsion thus prepared were added the sodium salt of 5,5'-dichloro-9-ethyl-3,3'-bis(3-sulfopropyl)oxacarbocyanine as a sensitizing dye, 4-hydroxy-6-methyl-1,3,3a,7-tetraazaindene as a stabilizer, a dispersion of polyethyl acrylate, polyethylene glycol, 1,3-vinylsulfonyl-2-propanol, and Compound I-9 of the present invention.

The resulting mixture was then coated on a polyethylene terephthalate support in such an amount that the amount of silver coated was 3.4 g/m$^2$, to thereby produce Comparative Samples 1 and 2. Samples 3 to 10 of the present invention were prepared by coating the above mixture on a polyvinyl alcohol layer which had been previously coated on the polyethylene terephthalate support, the polyvinyl alcohol layer containing Compound II-1 of the present invention, in such an amount that the amount of silver coated was 3.4 g/m$^2$, or on a cellulose diacetate layer which had been previously coated on the polyethylene terephthalate support, the cellulose diacetate layer containing Compound II-3 of the present invention, also in such an amount that the amount of silver coated was 3.4 g/m$^2$.

The type of acid polymer (compound II), the amount of acid polymer, and the amount of Compound I-9 for each sample are shown in Table 1 below.

Each sample was exposed and developed, and then measured for photographic characteristics. The results are shown in Table 1. It can be seen from the results of Table 1 that Samples 3 to 10 of the present invention are greatly improved in formation of black spots as compared with Comparative Samples 1 and 2 at the same photographic performance.

TABLE 1

| Sample No. | Type of Acid Polymer (layer containing acid polymer) | Amount of Acid Polymer Added (mg/m$^2$) | Amount of Compound I-9 Added /mol Ag | Surface pH | Photographic Characteristics Sensitivity | Photographic Characteristics γ | Evaluation of Black Spots |
|---|---|---|---|---|---|---|---|
| 1 (Comparison) | — | — | $3 \times 10^{-3}$ | 6.2 | 100 | 17 | 2 |
| 2 ( " ) | — | — | $3.3 \times 10^{-3}$ | " | 107 | 18 | 1 |
| 3 (Invention) | II-1 (polyvinyl alcohol layer) | 60 | $3.3 \times 10^{-3}$ | 5.7 | 102 | 16.5 | 4 |
| 4 ( " ) | " (polyvinyl alcohol layer) | " | $3.6 \times 10^{-3}$ | " | 107 | 17 | 3.5 |
| 5 ( " ) | II-3 (cellulose diacetate layer) | 75 | $3.3 \times 10^{-3}$ | 5.8 | 102: 17 | 4 | |
| 6 ( " ) | " (cellulose diacetate layer) | " | $3.6 \times 10^{-3}$ | " | 112 | 18 | 3.5 |
| 7 ( " ) | " (cellulose diacetate layer) | 100 | $3.3 \times 10^{-3}$ | 5.6 | 100 | 17 | 4.5 |
| 8 ( " ) | " (cellulose diacetate layer) | " | $3.6 \times 10^{-3}$ | " | 102 | 17 | 4 |
| 9 ( " ) | " (cellulose diacetate layer) | 150 | $3.6 \times 10^{-3}$ | 5.0 | 95 | 16 | 5 |
| 10 ( " ) | " (cellulose diacetate layer) | " | $3.9 \times 10^{-3}$ | " | 107 | 17.5 | 4 |

Note:

1. The relative sensitivity is the reciprocal of an exposure amount to provide a density of 1.5 by development under conditions of 38° C. and 30 seconds, and is indicated as a relative value with that of Sample 1 as 100.
2. The formation of black spots was examined under a microscope and evaluated by the five grade evaluation, "5" indicates the best quality, and "1", the worst quality.
   5, 4: Commercially usable
   3: Commercially usable, but not satisfactory
   2, 1: Commercially unusable
   3.5: Between 3 and 4. 4.5: Between 4 and 5.
3. The evaluation of black spots was conducted based on the results of development under conditions of 38° C. and 30 seconds when the pH of the developer rose to 11.8.
4. The surface pH measured by the same manner as in Example 1 of Fuji lith ortho film, GO-100 (No. 026-KK11P) commercially manufactured by Fuji Photo Film Co., Ltd. or ULTRATEC UGF film (No. Z-2583-126-18-3) commercially manufactured by Instamatic Kodak Co., Ltd. is 6.0 or 6.1, respectively.

EXAMPLE 2

On a cellulose diacetate (0.75 g/m$^2$) layer containing Compound II-11, which had been previously coated on a polyethylene terephthalate support, were coated at the same time the same cubic monodispersion emulsion as described in Example 1 except adding Compound I-9 or I-25 thereto and an aqueous gelatin solution as a protective layer in such an amount that the amount of silver coated was 3.4 g/m$^2$. The lowermost layer (the cellulose diacetate layer) was an acid polymer layer. The amount of Compound II-11 and the type and amount of compound I for each sample are shown in Table 2 below.

Each sample was exposed and developed, and measured for photographic characteristics and formation of black spots. The results are shown in Table 2.

It can be seen from the results of Table 2 that Samples 15 to 18 of the present invention show decreased formation of black spots and have good photographic properties.

TABLE 2

| Sample No. | Amount of Compound II-11 Added (mg/m$^2$) | Type of Compound I | Amount of Compound I Added (/mol Ag) | Surface pH | Photographic Characteristics Sensitivity | Photographic Characteristics γ | Black Spots |
|---|---|---|---|---|---|---|---|
| 11 (Comparison) | — | I-9 | $3.3 \times 10^{-3}$ | 6.2 | 100 | 17.5 | 2 |
| 12 (Comparison) | — | " | $3.9 \times 10^{-3}$ | " | 112 | 18 | 1.5 |
| 13 (Comparison) | — | I-25 | $2 \times 10^{-4}$ | " | 102 | 15.5 | 2 |
| 14 (Comparison) | — | " | $4 \times 10^{-4}$ | " | 107 | 16 | 1 |
| 15 (Invention) | 500 | I-9 | $3.6 \times 10^{-3}$ | 5.5 | 98 | 16.0 | 4.0 |
| 16 (Invention) | " | " | $4.2 \times 10^{-3}$ | " | 105 | 17.5 | 3.5 |

TABLE 2-continued

| Sample No. | Amount of Compound II-11 Added ($mg/m^2$) | Type of Compound I | Amount of Compound I Added (/mol Ag) | Surface pH | Photographic Characteristics Sensitivity | γ | Black Spots |
|---|---|---|---|---|---|---|---|
| 17 (Invention) | " | I-25 | $3 \times 10^{-4}$ | " | 95 | 14.5 | 4.0 |
| 18 (Invention) | " | " | $5 \times 10^{-4}$ | " | 102 | 16.0 | 3.0 |

*Comparative Samples 11 to 14 do not contain an acid polymer.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic material comprising a support and at least one silver halide emulsion layer on the support, and containing in said emulsion layer or in a light-insensitive hydrophilic colloid layer a hydrazine derivative, wherein the photographic material further contains an acid polymer having from 40 to 100 mol % based on the polymer of a repeating unit comprising a carboxylic acid group or a carboxylic acid anhydride group thereof and in which the pH of the surface of the material is not more than 5.8 wherein fewer black spots are formed on said photographic material and wherein said photographic material has substantially the same high sensitivity and high contrast as compared to said photographic material not containing said acid polymer.

2. The negative silver halide photographic material as claimed in claim 1, wherein the acid polymer is incorporated in said emulsion layer.

3. The negative silver halide photographic material as claimed in claim 1, wherein the acid polymer is incorporated in a light-insensitive hydrophilic colloid layer.

4. The negative silver halide photographic material as claimed in claim 1, wherein the photographic material contains a hydrophobic polymer layer, and the acid polymer is incorporated in the hydrophobic polymer layer.

5. The negative silver halide photographic material as claimed in claim 1, wherein the acid polymer is a copolymer of butyl acrylate and acrylic acid.

6. The negative silver halide photographic material as claimed in claim 1, wherein the hydrazine derivative is a compound represented by the general formula (I):

$$R_1NHNHCHO \quad (I)$$

wherein $R_1$ is an aliphatic, aromatic, or heterocyclic group.

7. The negative silver halide photographic material a claimed in claim 1, wherein the aliphatic group represented by $R_1$ has 1 to 30 carbon atoms.

8. The negative silver halide photographic material as claimed in claim 7, wherein $R_1$ is a straight, branched or cyclic alkyl group having 1 to 20 carbon atoms.

9. The negative silver halide photographic material as claimed in claim 6, wherein in the aromatic or heterocyclic group represented by $R_1$ in the general formula (I) is a mono- or bicyclic aryl group or an unsaturated heterocyclic group.

10. The negative silver halide photographic material as claimed in claim 6, wherein the amount of the compound of the general formula (I) is $1 \times 10^{-6}$ to $1 \times 10^{-}$mol per mol of silver halide.

11. The negative silver halide photographic material as claimed in claim 6, wherein the amount of the compound of general formula (I) is $1 \times 10^{-5}$ to $4 \times 10^{-2}$ mol per mol of silver halide.

12. The negative silver halide photographic material as claimed in claim 1, wherein the acid polymer is present in an amount of 10 $mg/m^2$ to 10 $g/m^2$.

13. A method for forming a superhigh contrast negative image using a negative silver halide photographic material comprising a support and at least one silver halide emulsion layer on the support, and containing in said emulsion layer or in a light-insensitive hydrophilic colloid layer a hydrazine derivative, which comprises exposing imagewise the photographic material and then developing with a developer containing at least 0.15 mol/l of sulfite ion and having a pH of from 10.5 to 12.3, wherein the photographic material contains an acid polymer having from 40 to 100 mol % based on the polymer of a repeating unit comprising a carboxylic acid group or a carboxylic acid anhydride group thereof and the pH of the surface of the material is not more than 5.8 wherein fewer black spots are formed on said photographic material and wherein said photographic material has substantially the same high sensitivity and high contrast as compared to said photographic material not containing said acid polymer.

14. The method as claimed in claim 13, wherein the acid polymer is incorporated in said emulsion layer.

15. The method as claimed in claim 13, wherein the acid polymer is incorporated in a light-insensitive hydrophilic colloid layer.

16. The method as claimed in claim 13, wherein the photographic material contains a hydrophobic polymer layer, and the acid polymer is incorporated in the hydrophobic polymer layer.

17. The method as claimed in claim 13, wherein the acid polymer is a copolymer of butyl acrylate and acrylic acid.

18. The method as claimed in claim 13, wherein the hydrazine derivative is a compound represented by the general formula (I):

$$R_1NHNHCHO \quad (I)$$

wherein $R_1$ is an aliphatic, aromatic, or heterocyclic group.

19. The method as claimed in claim 13, wherein the aliphatic group represented by $R_1$ has 1 to 30 carbon atoms.

20. The method as claimed in claim 19, wherein $R_1$ is a straight, branched or cyclic alkyl group having 1 to 20 carbon atoms.

21. The method as claimed in claim 18, wherein the aromatic or heterocyclic group represented by $R_1$ in the general formula (I) is a mono- or bicyclic aryl group or an unsaturated heterocyclic group.

22. The method as claimed in claim 18, wherein the amount of the compound of the general formula (I) is $1\times10^{-6}$ to $1\times10^{-1}$ mol per mol of silver halide.

23. The method as claimed in claim 18, wherein the amount of the compound of general formula (I) is $1\times10^{-5}$ to $4\times10^{-2}$ mol per mol of silver halide.

24. The method as claimed in claim 13, wherein the acid polymer is present in an amount of 10 mg/m$^2$ to 10 g/m$^2$.

* * * * *